United States Patent [19]

Ishida et al.

[11] 4,175,245

[45] Nov. 20, 1979

[54] MAGNETRON MAGNET ASSEMBLY

[75] Inventors: Yoshio Ishida; Masao Sakai; Mamoru Tsuzurahara; Ichiro Inamura; Tomokatsu Oguro, all of Mobara, Japan

[73] Assignee: Hitachi, Ltd., Tokyo, Japan

[21] Appl. No.: 880,585

[22] Filed: Feb. 23, 1978

[30] Foreign Application Priority Data

Jun. 24, 1977 [JP] Japan ..... 52/82501[U]

[51] Int. Cl.[2] ..... H01J 25/50

[52] U.S. Cl. ..... 315/39.71; 315/39.51; 315/39.75

[58] Field of Search ..... 315/39.71, 39.75, 39.51, 315/39.53

[56] References Cited

U.S. PATENT DOCUMENTS

| | | | |
|---|---|---|---|
| 3,987,333 | 10/1976 | Nakada et al. | 315/39.71 |
| 4,048,542 | 9/1977 | Miura | 315/39.71 |
| 4,075,534 | 2/1978 | Saito et al. | 315/39.71 |

*Primary Examiner*—Saxfield Chatmon, Jr.
*Attorney, Agent, or Firm*—Charles E. Pfund

[57] ABSTRACT

At least one permanent magnet and a pole piece having a projection is contained in an evacuated envelope formed by an anode cylinder and yokes on the opposite ends thereof. The permanent magnet and the pole piece is clamped between one yoke and a holder secured to the inner wall of the anode cylinder. The holder is provided with an opening a little smaller than the outer diameter of the projection and the projection is force-fitted into the opening to project into an interaction space defined between anode vanes and the cathode electrode.

7 Claims, 5 Drawing Figures

MAGNETRON MAGNET ASSEMBLY

BACKGROUND OF THE INVENTION

This invention relates to a magnetron, more particularly to a magnetron of the type wherein permanent magnets are contained in an evacuated envelope.

The magnetron of this type is shown for example by FIG. 2 of the papers entitled "A Hitachi's New Magnetron with an Inserted Magnetic Circuit" which was prepared and reported by Inchiro Inamura et al at the International Microwave Power Institute Symposium of May 26, 1977. With this type of the magnetron as it is possible to dispose the permanent magnet close to the interaction space defined between the cathode electrode and the anode vanes, the leakage of the flux of the magnetic path is decreased thus increasing the utilization factor of the flux. Accordingly it is possible to miniaturize the magnet and magnetron. For this reason, this type is considered important.

In this type of the magnetron, for the purpose of preventing diffusion of the electrons emitted from the cathode filament into the interaction space end shields are mounted on the opposite ends of the filament and the diameter of the end shields is made a little smaller than the inner diameter of the vanes. On the other hand, when the inner diameters of the ring shaped magnet and the pole piece thereof through which the support of the cathode structure constituted by the filament and the end shields extend is made small as far as possible, it is possible to make uniform the field distribution in the interaction space so that the inner diameters of the pole piece and the magnet are generally made smaller than the outer diameter of the end shield.

The input side of such magnetron is assembled by arranging a yoke around a support which is secured to a stem for holding the cathode structure, mounting on the yoke split halves of the magnet and pole piece in this order, inserting these magnet and pole piece halves while holding them by the aid of a suitable holding member, and finally welding the yoke to the anode cylinder.

The permanent magnet made of such a brittle material as samarium-cobalt is formed to a ring shape prior to assembling and split into halves for its arrangement around the support, so that no shoulder or stepped portion between the two halves is formed after completion of assembling. The pole piece made of iron, however, has difficulties with its separation into two halves, which is easy for the magnet as mentioned above, and therefore two halves of the pole piece are manufactured independently, i.e., not through the separation of single pole piece. This leads to dimensional errors of the independently manufactured two halves of the pole piece and a consequent shoulder between them even if they are positioned with accuracy. More particularly, the magnet and the pole piece are disposed between a yoke, one component element of the envelope, and the holder which is secured to the inner wall of the envelope. The holder is provided with an opening larger than the projection of the pole piece extending through the opening so that by the engagement of the projection and the inner wall of the opening, the flat surface of the pole piece is caused to contact the opposing surface of the holder. If the above described gap were formed they do not contact each other uniformly. Such imperfect contact increases resistance to the flow of surface current which results in concentration of electric field thus causing spark and local heating. Consequently, gas is released to damage the heated cathode filament. Also, the generation of the aforementioned spark has its heat which is transmitted to the magnet, thereby causing the magnet to be heated above 300° C. As above described the magnet is generally made of a sintered samarium-cobalt so that when the magnet is heated to a temperature of higher than 300° C., its magnetromotive force is lost.

SUMMARY OF THE INVENTION

Accordingly, it is the object of this invention to provide an improved magnetron capable of preventing spark due to microwave current which flows through a gap in the surface of the inner wall of the evacuated envelope or the surfaces of the component elements contained in the envelope, melting of the metal caused by the spark, and deterioration of the filament caused by the released gas.

According to this invention there is provided a magnetron of the type comprising an anode cylinder, a pair of yokes mounted on the opposite ends of the anode cylinder, the anode cylinder and the yokes forming an evacuated envelope, a plurality of radial anode vanes secured to the inner wall of the anode cylinder to define an interaction space, a cathode electrode structure mounted in the interaction space, a holder secured to the inner wall of the anode cylinder, a pole piece having a projection and a permanent magnet which are disposed between one of the yokes and the holder, wherein the holder is provided with an opening at the center thereof having a diameter smaller than the outer diameter of the projection and the projection is force-fitted into the opening to project into the interaction space.

Where another permanent magnet and pole piece are provided between the other yoke and an additional holder, the projection of the pole piece is also force-fitted into an opening of the additional holder.

DESCRIPTION OF THE PREFERRED EMBODIMENTS

Figure 1:
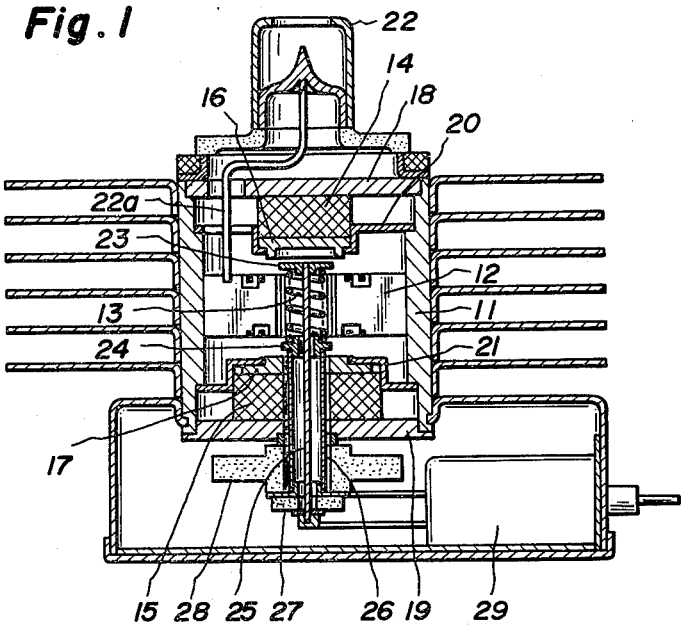
FIG. 1 is a longitudinal sectional view of one embodiment of the magnetron according to this invention.

A preferred embodiment of this invention shown in FIG. 1 comprises an anode cylinder 11 constituting an evacuated envelope together with the yokes to be described later. A plurality of radial anode vanes 12 are secured to the inner wall of the anode cylinder. The magnetron further comprises a cathode filament 13 for emitting thermal electrons, permanent magnets 14 and 15 contained in the envelope, pole pieces 16 and 17 secured to one surfaces of the magnets 14 and 15 for uniformly distributing the magnetic flux produced by the permanent magnets through the interaction space defined between the anode vanes 12 and the filament, and yokes 18 and 19 secured to the opposite ends of the anode cylinder 11. Nonmagnetic holders 20 and 21 are provided to hold the permanent magnets 14 and 15 and pole pieces 16 and 17 against the yokes. An output antenna 22 is mounted on the top of the magnetron and end shields 23 and 24 are secured to the filament to prevent diffusion of the thermal electrons emitted by the filament 13. The filament and the end shield comprise a cathode structure. One end of the filament is supported by a center lead wire through the end shield 23 and the other end of the filament is supported by a heat dam 26 through the end shield, the heat dam constituting a path for the filament current together with the center lead wire. A stem 27 is provided to support the center lead wire 25 and the heat dam 26 and soldered to yoke 19 through a ceramic plate 28. A filter 29 is provided to prevent leakage of unwanted microwave through power feed lines and for supplying high operating voltage to the magnetron.

In the magnetron described above, for the purpose of preventing diffusion of the electrons emitted by the filaments out of the invention space, the diameter of the end shields 23 and 24 is made to be slightly smaller than the inner diameter of the anode vanes 12, the inner diameters of the pole piece 17 and the permanent magnet 15 are made to be smaller than the diameter of the end shield 24 because decrease in the diameter increases the magnetic field intensity. The input side (lower side as viewed in FIG. 1) of the magnetron is assembled according to the following order. More particularly, center lead 25, heat dam 26, stem 27, ceramic plate 28 and yoke 19 are held by a jig and assembled by using a silver-copper solder in hydrogen gas. Then, center lead wire 25, heat dam 25, end shields 23 and 24, and filament 13 are assembled by using a rutheniummoylbdenum solder and heat radiations at a high temperature of about 1900° C. At this time, the pole piece 17 made of iron and the permanent magnet 15 made of Alnico (trade name) or a sintered samarium-cobalt are dismounted for the purpose of preventing melting and demagnetization, and after completion of the soldering step they are mounted on the outside of the heat dam 26.

The feature of this invention will now be described with reference to FIGS. 2 and 3. As shown, the diameter of the opening at the center of the holder is made to be slightly smaller than the outer diameter of a ring shaped projection 17*a* of the pole piece 17 so as to force fit the projection into the opening. Accordingly, a portion h comprises the force fit between the holder 21 and the pole piece 17. The projection 17*a* is provided for the purpose of providing a uniform magnetic field in the interaction space. To facilitate force fit of the pole piece 17 into the opening of the holder 21 radial slits 22 are formed near the inner periphery of the opening of the holder 21. In FIG. 3, 30 shows the seams of the pole piece 17.

Although in the foregoing description, split pole piece 17 on the input side was held by holder 21, the invention is also applicable to integral pole piece 16 on the output side which is held by holder 20. More particularly, since the intensity of the electromagnetic field near the lead wire 22*a* to the output antenna 22 shown in FIG. 1 is high, the electrical contact between the pole piece 16 and the holder 16 must be perfect. In this case, since the pole piece 16 is integral, the upper surface thereof is considered to be flat. However, as the holder has a thickness of from 0.2 to 0.5 mm and prepared by press work, it flexes so that the holder does not perfectly contact the pole piece along the entire periphery thereof. If gaps were formed along from 1/5 to $\frac{1}{4}$ of the periphery spark would be formed at such gaps due to high frequency surface field thus causing partial melting, release of gas or demagnetization of the magnet by heat conduction. As has already been described in connection with the input side, the diameter of the opening of the holder 20 is made to be smaller than the outer diameter of the pole piece 16 and the pole piece is force-fitted in the opening for preventing the difficulties described above.

As above described according to this invention as the pole piece is force-fitted in the opening of the holder, perfect contact can be assured therebetween along the entire periphery. Accordingly, even when microwave surface current flows in the surfaces of the holder and the pole piece during the operation of the magnetron it is possible to effectively prevent such defects as spark, release of gas and demagnetization of the magnet.

In addition, since the pole piece can be secured at the center of the holder, it is possible to mount the pole piece at the center of the magnetron without any eccentricity thus preventing nonuniform distribution of the field thereby improving the operating efficiency of the magnetron.

Figure 2:
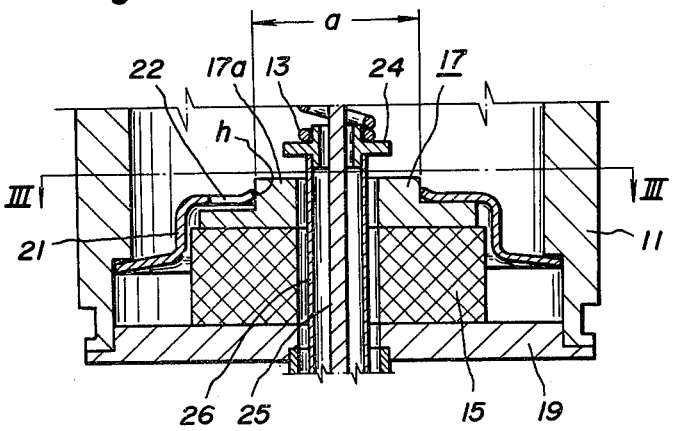
FIG. 2 is an enlarged sectional view showing the joints between a magnet and a pole piece and between a holder and a pole piece.
Figure 3:
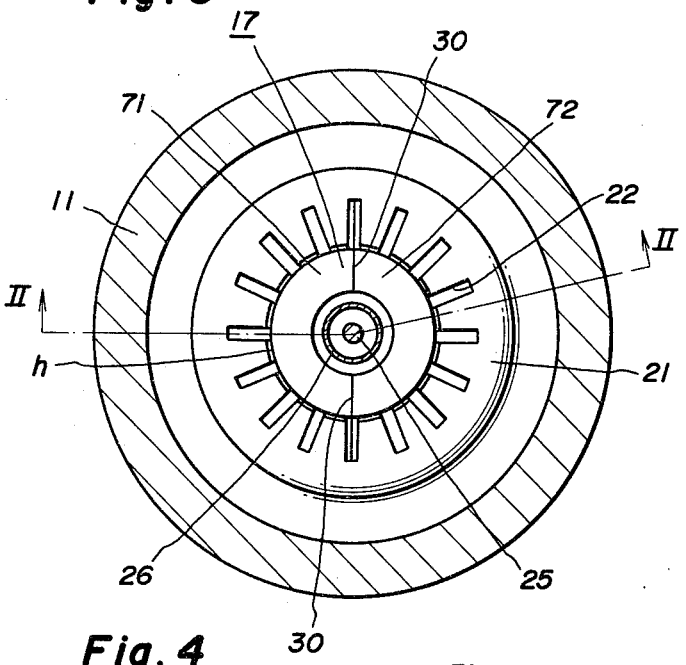
FIG. 3 is a sectional view taken along a line III—III shown in FIG. 2.
Figure 4:
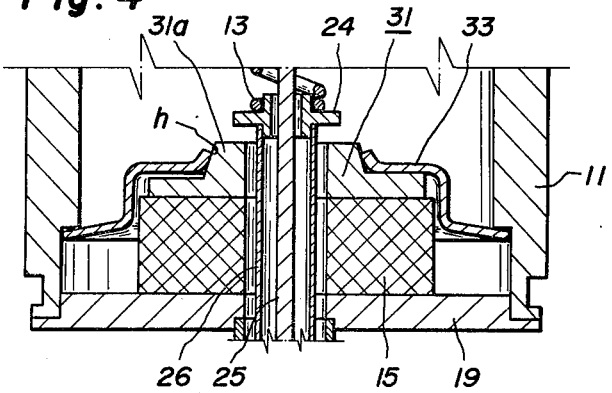
FIGS. 4 and 5 are sectional views corresponding to FIG. 2 and showing modified embodiments of this invention.
Figure 5:
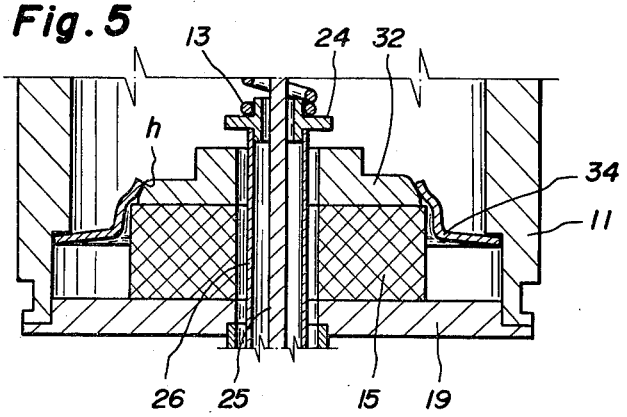

FIGS. 4 and 5 show modified embodiment of this invention in which elements corresponding to those shown in FIG. 2 are designated by the same reference characters. In these modifications, the outer periphery of the pole pieces 31 and 32 are tapered so as to facilitate insertion thereof into the openings of the holders 33 and 34 respectively. In the case shown in FIG. 4, the pole piece 31 has a step shape and the smaller diameter portion thereof is force-fitted into the opening of the holder 33 whereas in the case shown in FIG. 5, the larger diameter portion of the pole piece 32 is force-fitted into the opening of the holder 34. In each case, at a portion h the pole piece is force-fitted into the holder.

Instead of constructing the pole piece and the permanent magnet as separate members they may be constructed as an integral unit.

What is claimed is:

1. In a magnetron of the type comprising an anode cylinder, a pair of yokes mounted on the opposite ends of said anode cylinder, said anode cylinder and said yokes forming an evacuated envelope, a plurality of radial anode vanes secured to the inner wall of said anode cylinder to define an interaction space, a cathode electrode structure mounted in said interaction space, a holder located within said evacuated envelope and secured to the inner wall of said anode cylinder, a pole piece having a projection and a permanent magnet which are interposed between one of said yokes and said holder, the improvement wherein said holder is provided with an opening at the center thereof having a diameter smaller than the outer diameter of said projection and said projection is force-fitted in said opening to project into said interaction space.

2. The magnetron according to claim 1 wherein said holder is provided with a plurality of radial slits about said opening.

3. The magnetron according to claim 1 wherein said pole piece and said permanent magnet are integral.

4. The magnetron according to claim 1 wherein said pole piece projection comprises an annular projection.

5. The magnetron according to claim 4 wherein the peripheral surface of said projection is tapered and wherein said holder engages said tapered peripheral surface when said projection is force-fitted into the opening of said holder.

6. In a magnetron of the type comprising an anode cylinder, a pair of yokes mounted on the opposite ends of said anode cylinder, said anode cylinder and said yokes forming an evacuated envelope, a plurality of radial anode vanes secured to the inner wall of said anode cylinder to define an interaction space, a cathode electrode structure mounted in said interaction space, a holder secured to the inner wall of said anode cylinder, a pole piece having a projection and a permanent magnet which are interposed between one of said yokes and said holder, the improvement wherein said holder is provided with an opening at the center thereof having a diameter smaller than the outer diameter of said projection and said projection is force-fitted in said opening to project into said interaction space and wherein said pole piece comprises a large diameter portion and a small diameter portion and the outer periphery of said large diameter portion is tapered, said large diameter portion being force-fitted into the opening of said holder so that said holder engages said tapered outer periphery.

7. In a magnetron of the type comprising an anode cylinder, a pair of yokes mounted on the opposite ends of said anode cylinder, said anode cylinder and said yokes forming an evacuated envelope, a plurality of radial anode vanes secured to the inner wall of said anode cylinder to define an interaction space, a cathode electrode structure mounted in said interaction space, a pair of holders located within said evacuated envelope and secured to the inner wall of said anode cylinder, and two pole pieces, each having a projection and an associated permanent magnet, each pole piece and associated magnet being disposed between one of said yokes and one of said holders, the improvement wherein each holder is provided with an opening at the center thereof having a diameter smaller than the outer diameter of said projection, and the projections of respective pole pieces are force-fitted into the openings of respective holders to project into said interaction space.

* * * * *